United States Patent [19]

Wiley et al.

[11] 4,246,565

[45] Jan. 20, 1981

[54] RETENTION PLUG

[75] Inventors: George R. Wiley, Upland; Francis F. Dewees, Riverside, both of Calif.

[73] Assignee: Bourns, Inc., Riverside, Calif.

[21] Appl. No.: 30,496

[22] Filed: Apr. 16, 1979

Related U.S. Application Data

[63] Continuation of Ser. No. 811,119, Jun. 29, 1977, abandoned.

[51] Int. Cl.[3] ..... H01C 10/32

[52] U.S. Cl. ..... 338/163; 338/162; 338/174

[58] Field of Search ..... 338/160, 162, 163, 174, 338/188; 200/11 G, 11 J, 11 K; 248/239

[56] References Cited

U.S. PATENT DOCUMENTS

| | | | |
|---|---|---|---|
| 2,657,894 | 11/1953 | Sklenar | 403/252 X |
| 2,937,834 | 5/1960 | Orenick et al. | 85/81 X |
| 3,032,734 | 5/1962 | Zunker et al. | 338/162 |
| 3,594,527 | 7/1971 | Brant | 200/11 G |
| 3,628,816 | 12/1971 | Ross | 85/72 X |
| 3,961,302 | 6/1976 | Hufford | 338/163 |

FOREIGN PATENT DOCUMENTS

| | | | |
|---|---|---|---|
| 2519051 | 11/1975 | Fed. Rep. of Germany | 338/162 |
| 948297 | 1/1964 | United Kingdom | 338/174 |

*Primary Examiner*—C. L. Albritton
*Attorney, Agent, or Firm*—William G. Becker

[57] ABSTRACT

A component to be attached to a substrate or plate or other element including a hollow bushing having an extension for mounting directly to such other element. The extension is provided with a radially compressible shoulder portion engageable upon insertion into an aperture and a rod-like member to be seated firmly in the hollow bushing to prevent the relaxation and flexure of said bushing. In a preferred embodiment the rod-like member may be integrally molded with the component to be attached.

1 Claim, 6 Drawing Figures

RETENTION PLUG

This application is a continuation of application Ser. No. 811,119, filed June 29, 1977, now abandoned.

BACKGROUND OF THE INVENTION

1. Field of the Invention

This invention relates generally to means for securing elements together and more particularly to securing a movable element to a relatively stationary element.

2. Description of the Prior Art

Components are known in which mounting is effected to a panel or plate and/or elements of a component are attached together by means of a bushing having a base, a hollow, extending, resilient portion, a shoulder and a tapered portion. Parts or elements are retained in their attachment by means of the normal spring-like resiliency of the material of the bushing and the shoulder portion formed thereon.

While presently available materials exhibit strong elastic forces and thus high resistance to deformation, some of these materials may soften with age or temperature. For some other reason the bushing may be allowed to relax or flex and thus the attached elements may come apart. Thus, the rotor on a miniature potentiometer, for example, may "pop" out under conditions of stress. Some of these prior art devices have been described in the following listed patents which were brought to the attention of the applicant:

1. U.S. Pat. No. 3,500,282—J. E. Slagg—"Panel Mounted, Variably Adjusted Electrical Component"
2. U.S. Pat. No. 3,662,314—Juan-Luis Hereaero—'-'Adjustable Annular Potentiometer with Terminal Attachment Means"
3. U.S. Pat. No. 3,319,484—E. W. J. Prest—"Means for Coupling Shaft and Bushing"
4. U.S. Pat. No. 3,617,978—George A. Gerstmeier—"Rotor and Contact Assembly for Variable Resistance Device"

It would thus be a great advantage to the art to provide an attachment arrangement in which the elements would not separate under conditions of stress.

Another great advantage would be to provide such an arrangement in an economical and simple construct.

A further desirable advantage would be to provide such an arrangement wherein existing components might be easily modified so as to enjoy the advantages of the invention.

SUMMARY OF THE INVENTION

It is an object of the present invention to provide an attachment arrangement in which the elements will not separate under conditions of stress.

A further object of the present invention is to provide an arrangement in which the elements will not separate under conditions of stress in an economical and simple construct.

Still another object of the present invention is to provide such an arrangement wherein existing components may be easily modified so as to enjoy the advantages of the invention.

In the accomplishment of these and other objects, a retention plug or rod is provided in which the rod is firmly seated and held by frictional forces in a hollow portion of a bushing. The seated rod thus prevents the inward relaxation or flexure of the bushing and thus its involuntary expulsion from attachment with another element or part. Thus a component can be mounted to a plate or panel or two parts of a component may be attached together by the means contemplated in the invention without the danger of their accidentally "popping" apart. The seated rod can be removed if desired by the simple expedient of insertion of a pin in the hollow portion of the bushing and pushing with enough force to overcome the frictional forces holding the rod in place.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings, wherein like reference characters refer to like parts throughout, and in which.

DETAILED DESCRIPTION

Although a specific embodiment of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope, and contemplation of the invention as further defined in the appended claims.

Figure 1:
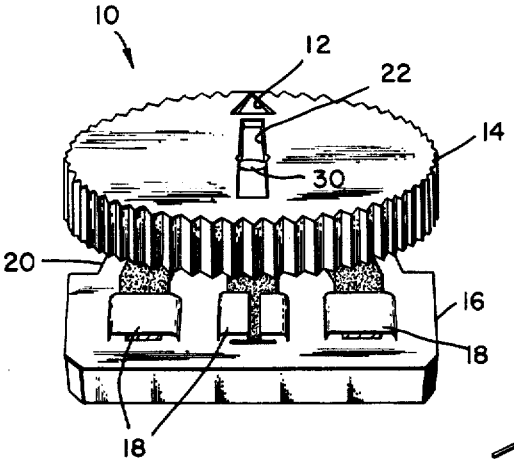
FIG. 1 is a top perspective view of a rotary component such as might be held together by the means contemplated by the invention.

Referring to FIG. 1 with greater particularity, an assembled component is denoted generally by the numeral 10. An index indicator is identified by the numeral 12 and a rotatable or attached member by the numeral 14. Numeral 16 identifies a component substrate or a plate. Terminals are denoted generally by the numeral 18 and a stop shoulder on the substrate 16 is denoted by the numeral 20.

Figure 2A:
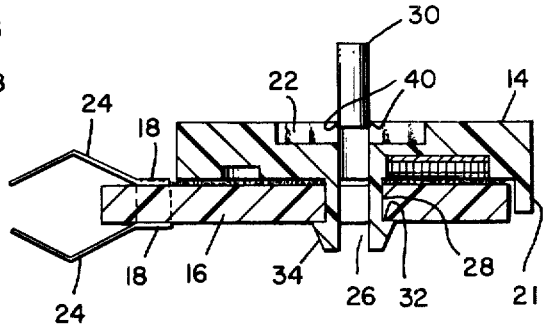
FIG. 2*a* is a sectional view of a component incorporating the teachings of the present invention and showing the integrally molded retention rod prior to rupture of its weak join and its subsequently being pressed into place.

Referring now to FIG. 2*a*, a recess 22 formed in the rotatable or attached member 14 is shown. Numeral 24 identifies terminal leads connected from terminals 18 and numeral 26 shows a slot in a bushing formed on rotatable or attached member 14. Numeral 28 denotes an aperture formed in component substrate or plate 16. Numeral 30 denotes a longitudinal plug or rod integrally formed with member 14. The longitudinal plug or rod 30 is shown in position to be installed within the bushing formed in rotatable or attached member 14.

Numeral 40 denotes a rupturable join fabricated at the time of molding plug 30 and member 14 of the same material.

Figure 2B:
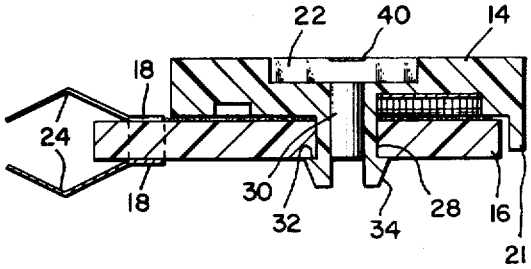
FIG. 2*b* is the same sectional view as FIG. 2*a* but showing the retention rod pressed into place so as to prevent flexure of the bushing.

Referring now to FIG. 2*b*, the longitudinal plug or rod 30 is shown after rupture of the join 40 and after having been pressed into place in the hollow bushing.

Figure 3:
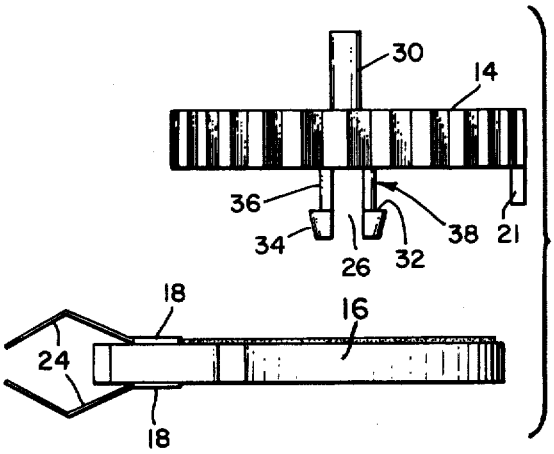
FIG. 3 is an exploded view of parts to be attached as contemplated by the invention.

FIG. 3 shows as its bottom element the component substrate or plate 16 in position to receive rotatable member or member to be attached or mounted 14 with its bushing 38 showing the shoulder 32 formed on said bushing by being stepped radially outward to provide a radially compressible shoulder portion and being tapered radially inward toward its distal end to provide a ramp-like taper 34 so as to facilitate the insertion and retention by means of shoulder 32 within the aperture 28 of substrate or plate 16. A hollow, extending, resilient portion of the bushing is denoted by the numeral 36. Above rotatable member or member to be attached or mounted 14 there is shown the longitudinal rod or plug 30 attached to member 14 by means of rupturable join 40, FIG. 2*a*. It may be seen that insertion of the longitudinal rod or plug 30 into the hollow, extending, resilient portion 36 will cause rupture of the join 40 and serve the purpose of keeping the extending resilient portion 36 extended. It will therefore be impossible for the bushing 38 to flex inwardly thus allowing the shoulder 32 to be accidentally compressed and thus released from component substrate or plate 16 and allowing pop-out of the member 14.

Figure 4:
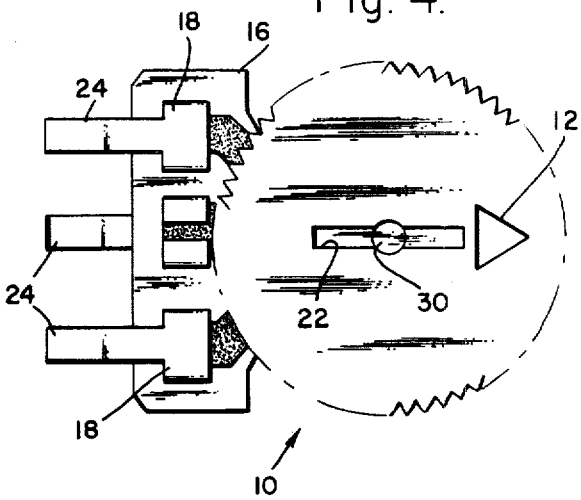
FIG. 4 is a top plan view of a component showing the retention rod of the invention in place.

FIG. 4 shows a top plan view of a component in order to provide clarity. The recess 22 formed in rotatable member or member to be attached or mounted 14 is shown from another perspective and the longitudinal rod or plug 30 is shown from that same perspective.

Figure 5:
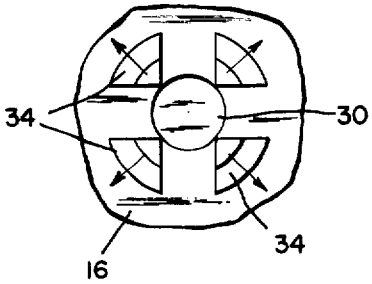
FIG. 5 is an enlarged fragmentary view of the bottom of an attachment as secured by the means of the invention showing the retention rod and indicating resultant forces on the bushing.

Referring now to FIG. 5, there is shown an enlarged fragmentary detail of a bottom plan view of the retention rod 30 in place to maintain the extension of the resilient portion 36 of bushing 38. The arrows denote the static forces superimposed upon the naturally elastic properties of the material of the bushing by the retention rod 30. It is easily understood therefrom that as long as the retention rod remains in place, it is impossible for the resilient portion of the bushing to flex inwardly.

Thus, there has been described means that will prevent the hollow, extending, resilient portion 36 of bushing 38 from relaxing after assembly and allowing the rotor or other attached assemblies to "pop out" of substrates. Thus a rotor assembly, for example, with a hollow, extending, resilient portion and an integrally formed longitudinal rod attached by a rupturable join as shown, may be pressed into a hole or aperture in a substrate. The assembly may then be placed into a fixture that presses the longitudinal rod into the hollow, extending, resilient portion of the bushing thus rupturing the join and seating the longitudinal plug or rod. This longitudinal rod or plug, held in place by frictional forces, thus becomes part of the rotor. The rod 30 thus inserted in the hollow bushing may provide some rotational resistance and thus contribute to the positional integrity of a rotatably adjustable component by making it somewhat resistive to a change in position due to vibrational forces. The provision of some rotational resistance is often otherwise built with adjustable potentiometers and other like rotatably adjustable components so as to provide a "feel", when adjusting the component, of a counteracting torque. The seated rod may be unseated and removed from the assembly by the simple expedient of pushing it with a suitable pin and with suitable force to overcome the frictional forces holding it in place.

Since the retention rod or plug in a preferred embodiment may be integrally molded with the member to be attached, manufacturing difficulties associated with assembly such as selecting and picking up the rod and positioning it to be seated are obviated. The weak join 40 makes such operations unnecessary for the purposes of the present invention.

Great improvements in ease of assembly, reliability, flexibility, maintainability, ease of mounting, and so forth have been provided through the novel advantages of the present invention. The integrity of the attachment by the means contemplated by the invention is many orders of magnitude greater than in the prior art. While desired disassembly of elements so attached may be accomplished with ease, accidental popping apart is most improbable.

It is pointed out that although the present invention has been shown and described with reference to particular embodiment, nevertheless various changes and modifications obvious to one skilled in the art to which the invention pertains are deemed to lie within the purview of the invention. The invention herein has been described in terms of a rotatable component generally by way of example only and it is not intended to restrict the invention to application specifically with a rotatable component.

What is claimed and desired to be secured by Letters Patent of the United States is:

1. A rotatable electrical device comprising:

a flat substrate of substantially uniform thickness having at least one first electrical contact thereon;

an aperture in said flat substrate positioned adjacent said first electrical contact;

a rotor having at least one second electrical contact on one side positioned to continually contact said first electrical contact;

a hollow articulated bushing formed unitarily with said rotor and rotatable attached to said flat substrate through said aperture, said bushing comprising:

elongated members forming a hollow, extending resilient cylindrical shank of longitudinal dimension bounded at its proximate extremity by said one side of said rotor and at the distal portion by a stepped shoulder, the distance between said one side of said rotor and said stepped shoulder being substantially the combined thickness of said flat substrate and said first electrical contact so as to provide rotatable attachment of said rotor to said flat substrate and mating between said first and second electrical contacts, a ramp-like taper extending from said stepped shoulder to the end of said bushing, said taper being provided to facilitate the insertion of said cylindrical shank into said aperture in said flat substrate;

a cylindrical retention rod of uniform diameter formed unitarily with said rotor at a rupturable joint that positions and retains said retention rod to said rotor prior to combination of said rotor with said flat substrate, such that an axial force applied to said rod toward said substrate ruptures said joint and pushes said rod into said hollow shank, said diameter of said rod relative to the inside diameter of said hollow shank being such as to prevent substantial radially inward flexing of said elongate members, while slightly increasing the rotational resistance between said bushing and said substrate to enhance the positional integrity of said rotor while maintaining the rotatable attachment between said bushing and said substrate.

* * * * *